US012378763B2

(12) United States Patent
McGregor

(10) Patent No.: US 12,378,763 B2
(45) Date of Patent: Aug. 5, 2025

(54) ADJUSTABLE BLIND

(71) Applicant: Umbra LLC, Buffalo, NY (US)

(72) Inventor: Brianna Daisy Harper McGregor, Ottawa (CA)

(73) Assignee: Umbra LLC, Buffalo, NY (US)

( * ) Notice: Subject to any disclaimer, the term of this patent is extended or adjusted under 35 U.S.C. 154(b) by 391 days.

(21) Appl. No.: 17/650,159

(22) Filed: Feb. 7, 2022

(65) Prior Publication Data

US 2023/0250635 A1 Aug. 10, 2023

(51) Int. Cl.
*E04B 2/74* (2006.01)

(52) U.S. Cl.
CPC .... *E04B 2/7459* (2013.01); *E04B 2002/7479* (2013.01)

(58) Field of Classification Search
CPC ..... E04B 2/7459; E04B 2002/7479; E04B 2/74; E04B 2/7453; E04B 2002/7461; E04B 2002/7466; A47H 65/00; E06B 2009/2622
See application file for complete search history.

(56) References Cited

U.S. PATENT DOCUMENTS 2,974,805 A 3/1961 Brosseau
3,035,708 A 5/1962 Freeman
3,465,487 A * 9/1969 Georges ..... E04B 2/78 52/301
3,757,705 A 9/1973 Maslow
3,771,466 A * 11/1973 Ferdinand ..... A47B 57/42 248/200.1
4,318,352 A 3/1982 Friedman et al.
5,676,263 A 10/1997 Chang
5,787,665 A * 8/1998 Carlin ..... E04B 2/7453 52/309.4
6,015,052 A 1/2000 Goldberg et al.
6,068,143 A 5/2000 Wang
6,079,575 A 6/2000 Wang
6,550,730 B1 4/2003 Hong
6,695,156 B1 2/2004 Wang
7,992,730 B2 8/2011 Huang
10,149,058 B2 * 12/2018 O'Polka ..... H04R 1/323
11,317,750 B2 5/2022 Mailach et al.
(Continued)

FOREIGN PATENT DOCUMENTS

JP 2018175370 A * 11/2018
KR 101683854 B1 * 5/2016

OTHER PUBLICATIONS

Wayfair, Noelle Room Divider by Beachcrest Home; Available at: https://www.wayfair.ca/furniture/pdp/beachcrest-home-noelle-room-divider-bcmh1929.html; Last Accessed Jul. 9, 2019.
(Continued)

*Primary Examiner* — Daniel P Cahn
*Assistant Examiner* — Matthew R. Shepherd
(74) *Attorney, Agent, or Firm* — Simpson & Simpson, PLLC

(57) ABSTRACT

An adjustable blind assembly, having a first and a second telescoping tension rod, an adjustable blind, said blind having a plurality of sleeves therein, each of said sleeves arranged to accept a transverse member, each of said transverse members having a first and a second endcap arranged on opposite ends of said transverse members, each of said endcaps arranged to engage one of said telescoping tension rods via an attachment means, and a height adjustment means fixedly secured to each of said telescoping tension rods.

15 Claims, 6 Drawing Sheets

(56) References Cited

U.S. PATENT DOCUMENTS

| | | | | |
|---|---|---|---|---|
| 2002/0017369 | A1* | 2/2002 | Peppett | B44C 5/02 160/378 |
| 2002/0113180 | A1 | 8/2002 | Wiebe | |
| 2003/0131767 | A1 | 7/2003 | Chen | |
| 2008/0035278 | A1* | 2/2008 | Lin | E06B 9/262 160/84.04 |
| 2012/0112445 | A1* | 5/2012 | Tezak | A63C 11/025 280/814 |
| 2021/0127883 | A1* | 5/2021 | Mailach | A47H 1/022 |

OTHER PUBLICATIONS

Bed Bath & Beyond; RoomDividersNow Freestanding Room Divider Kit with 9-foot Tall Curtain Panel; Available at: https://www.bedbathandbeyond.com/store/product/roomdividersnow-freestanding-room-divider-kit-with-9-foot-tall-curtain-panel-b/3305890?categoryId=13528; Last Accessed Jul. 9, 2019.

Rakuten; Simple thrust curtain pole; Available at: https://global.rakuten.com/en/store/gooddayshop/item/ab-1047616/; Last Accessed Jul. 9, 2019.

Rakuten; Easy tension curtain pole; Available at: https://item.rakuten.co.jp/auc-plumeef/10000188/?scid=af_pc_etc&sc2id=af_113_0_10001868; Last Accessed Jul. 9, 2019.

Amazon; Maytex 6099 Twist and Shout Smart Drill Tension 7/8 Window Curtain Drapery Rod; Available at: https://www.amazon.com/Maytex-Window-Hardware-48-84-Inch-Rubbed/dp/B00TV26BXI?creativeASIN=B00TV26BXI&linkCode=w61&imprToken=L4jNDIZSRw98sL5X2B9F6Q&slotNum=3; Last Accessed Jul. 9, 2019.

Amazon; Umbra Coretto 1/2-Inch Drapery Tension Rod; Available at: https://www.amazon.ca/Umbra-Coretto-Drapery-Tension-36-Inch/dp/B00FB6N67C/ref=sr_1_4?keywords=window+tension+rod&qid=1552597005&s=kitchen&sr=1-4; Last Accessed Jul. 9, 2019.

Kwik-hang; Curtain Rod Brackets; Available at: https://kwikhang.com/; Last Accessed Jul. 9, 2019.

Ikea; Schottis Pleated blind, white, 35 1/2x 74 3/4; Available at: https://www.ikea.com/ca/en/p/schottis-pleated-blind-white-20242282/; Last Accessed Jul. 9, 2019.

Jamie's Home Blog; How to Hang Curtains Like MacGyver; Available at: https://jamieshomeblog.com/2013/11/30/how-to-hang-curtains-like-macgyver/; Last Accessed Jul. 9, 2019.

HSN; outdoor curtain rod with post; Available at: https://www.improvementscatalog.com/outdoor-curtain-rod-with-post-set/outdoor-curtains/outdoor-curtain-hardware/280415; Last Accessed Jul. 9, 2019.

Wayfair; Don't Look at Me Privacy Room Divider; Available at: https://www.wayfair.ca/furniture/pdp/symple-stuff-dont-look-at-me-privacy-room-divider-syp14385.html; Last Accessed Jul. 9, 2019.

* cited by examiner

ADJUSTABLE BLIND

FIELD OF THE INVENTION

The present disclosure relates to an adjustable blind assembly, specifically an adjustable blind assembly having vertical adjustment means and an adjustable blind.

BACKGROUND

Blinds are well known in the art. Traditionally, blinds are used to block unwanted, incoming light from outside a window. The traditional blinds used for windows are generally secured in place and not easily moved. However, blinds may also be used in other settings, not just in front of a windowpane. Blinds can be used to block unwanted light, but also to block someone's line of sight. For example, blinds can be used to separate a living space if it is shared so that each person cannot freely see into the other's designated living space. These types of blinds are often called room dividers. While some room dividers can only be used in one location, but if they need to be moved in the future, they leave behind damage that may be costly to fix.

Thus, it is desirable for room dividers to be movable so they can be used in many locations and do not leave behind any damage.

Additionally, much like blinds used for windows, sometimes one may want to completely block the incoming light or someone's line of sight, but other times one may want to only partially block it. However, as traditional blinds only allow for partial obstruction of light or sight from the top of the blind in a downward direction, it may also be desirable to obstruct just the bottom half of an area from unwanted light or sight.

It may also be desired to use a room divider or blind for interior design or aesthetic reasons.

Thus, there is a long felt need for an adjustable blind having at least two telescoping tension rods and an adjustable blind or curtain to address and solve these problems.

SUMMARY

The present invention broadly comprises an adjustable blind assembly, having a pair of telescoping tension rods, an adjustable blind, said blind having a plurality of sleeves, each of said sleeves arranged to accept a transverse member, each of said transverse members having a pair of endcaps arranged on opposite ends of said transverse members, each of said endcaps arranged to engage each of said pair of telescoping tension rods, each of said endcaps having an attachment means and, a height adjustment means fixedly secured to each of said pair of telescoping tension rods. In a preferred embodiment the pair of telescoping tension rods are arranged vertically, spaced apart and parallel to one another and the transverse members are arranged horizontally and parallel to one another and perpendicular with respect to the vertical telescoping tension rods.

A general object of this invention is to provide an aesthetically pleasing adjustable blind assembly between any two flat surfaces and the blind being easily adjustable to fit different needs.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims.

It should also be appreciated that directional terms used herein are relative to the corresponding Figure being described. For example, "leftward" or "rightward", "top" or "bottom", are relative to the Figure as illustrated on a particular sheet, therefore "leftward" is referring to the left side of an illustration as depicted.

Figure 1B:
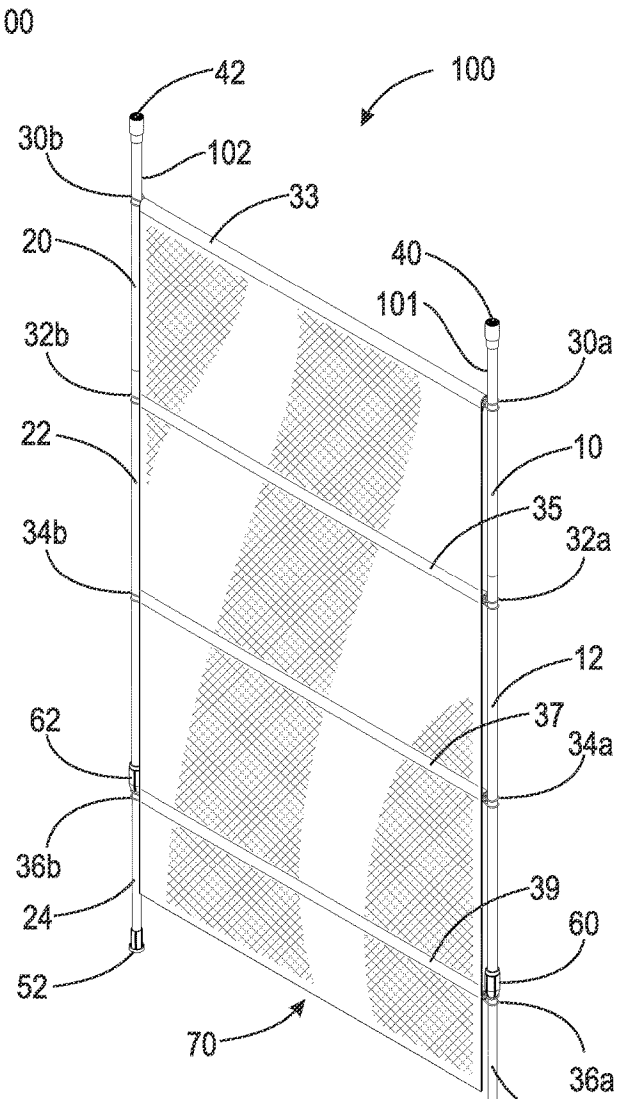
FIG. 1B is a front perspective view of the adjustable blind assembly.
Figure 1A:
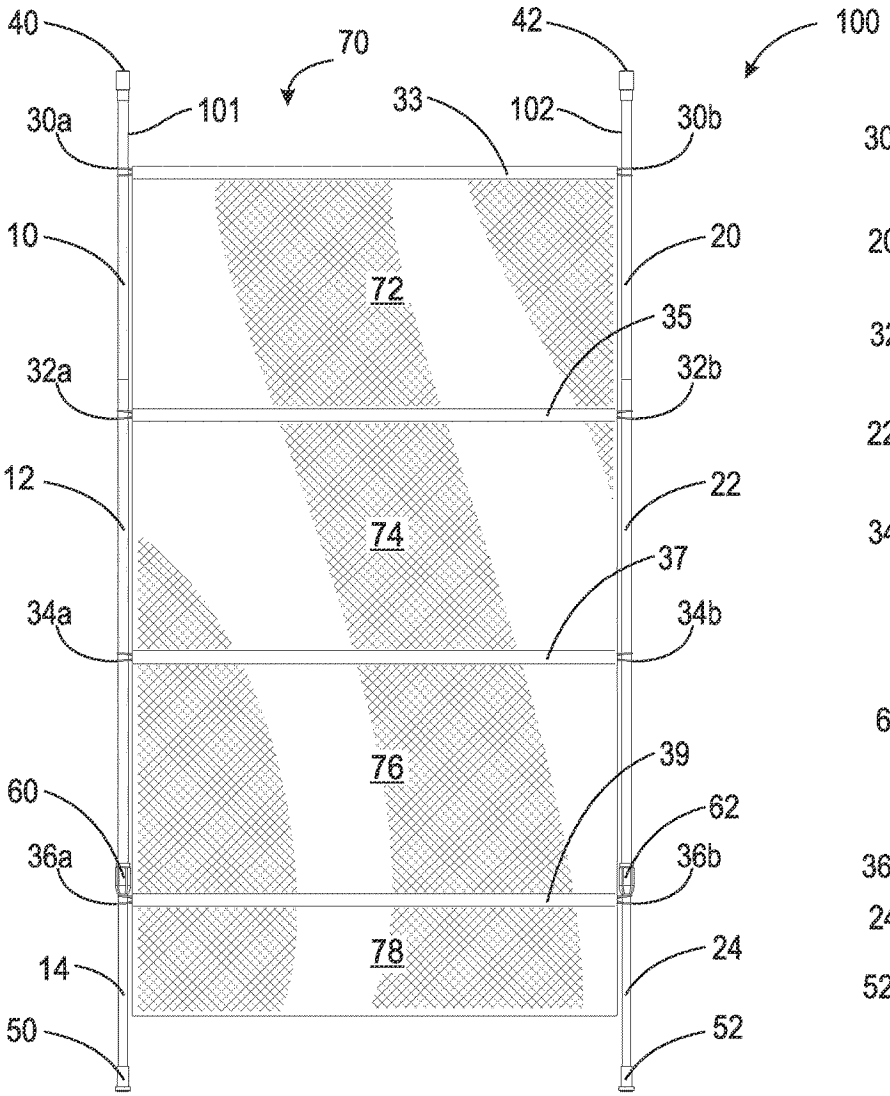
FIG. 1A is a rear view of an adjustable blind assembly.

Referring now to the figures, FIG. 1A is a rear view of adjustable blind assembly 100. Adjustable blind assembly 100 comprises first telescoping tension rod 101, second telescoping tension rod 102, transverse members 30, 32, 34, and 36, and adjustable blind 70. First telescoping tension rod 101 comprises spring-loaded top endcap 40, non-spring-loaded foot endcap 50, height adjuster 60, top member 10, middle member 12, and bottom member 14. Second telescoping tension rod 102 comprises spring-loaded top endcap 42, non-spring-loaded foot endcap 52, height adjuster 62, top member 20, middle member 22, and bottom member 24.

Transverse members 30, 32, 34, and 36 cannot be seen in FIG. 1A as they are contained within sleeves 33, 35, 37, and 39 when adjustable blind assembly 100 is fully assembled. Transverse member 30 comprises first attachment means 30*a*, and second attachment means 30*b*. Transverse member 32 comprises first attachment means 32*a*, and second attachment means 32*b*. Transverse member 34 comprises first attachment means 34*a*, and second attachment means 34*b*. Transverse member 36 comprises first attachment means 36*a*, and second attachment means 36*b*.

Adjustable blind 70 comprises top section 72, top middle section 74, lower middle section 76, lower section 78, and sleeves 33, 35, 37, and 39. Transverse members 30, 32, 34, and 36 fit tight into the respective sleeves 33, 35, 37, and 39 (shown more clearly in FIG. 1C). Attachment means 30*a*-36*a* and 30*b*-36*b* removably secure transverse members in a static position along first and second telescoping tension rods 101 and 102 (shown in detail in FIGS. 6A and 6B) and may be removably secured to any position along telescoping tension rods 101 and 102.

Bottom member 14 of telescoping tension rod 101 has a slightly smaller circumference than middle member 12, this allows bottom member 14 to insert into middle member 12 and facilitate the telescoping effect of first telescoping tension rod 101. Notwithstanding one end of top member 10, middle member 12 and top member 10 have the same circumference. One end of top member 10 has a slightly smaller circumference compared to the remainder of top member 10 and middle member 12 such that the smaller circumference of top member 10 allows it to insert into an end of middle member 12, wherein the location where top member 10's circumference changes rests on the end of middle member 12. The differences in circumferences of each member facilitate the telescoping element. Both first telescoping tension rod 101 and second telescoping tension rod 102, and its respective top 20, middle 22, and bottom 24 members, telescope in an identical manner.

Once the desired vertical length is found height adjusters 60 and 62 are then used to secure middle members 12, 22 and bottom members 14, 24 in place simply by twisting the height adjuster clockwise. If a different vertical length is desired, twist height adjusters 60 and 62 in a counterclockwise direction to allow middle members 12, 22 to telescope with bottom members 14, 24 and find the desired vertical length.

Spring-loaded top endcaps 40 and 42 are fixedly secured to the top of top members 10 and 20, respectively. Additionally, non-spring-loaded foot endcaps 50 and 52 are threadably secured to the bottom of bottom members 14 and 24, respectively. The compression spring within endcaps 40 and 42 provide the tension in telescoping tension rods 101 and 102 by pressing outwardly causing non-spring-loaded foot endcaps 50 and 52 to press against a floor surface, and spring-loaded top endcaps 40 and 42 to press against the ceiling surface. This tension causes telescoping tension rods 101 and 102 to remain in a substantially vertical and stable position.

FIG. 1B is a front perspective view of adjustable blind assembly 100. Notably, from a front view sleeve 33 is fully visible at the top of the blind 70, but sleeves 35, 37, and 39 are only slightly visible due to the perspective view. The seams which create sleeves 33, 35, 37, and 39 can be seen and extend across the entirety of blind 70 transversely.

Figure 1C:
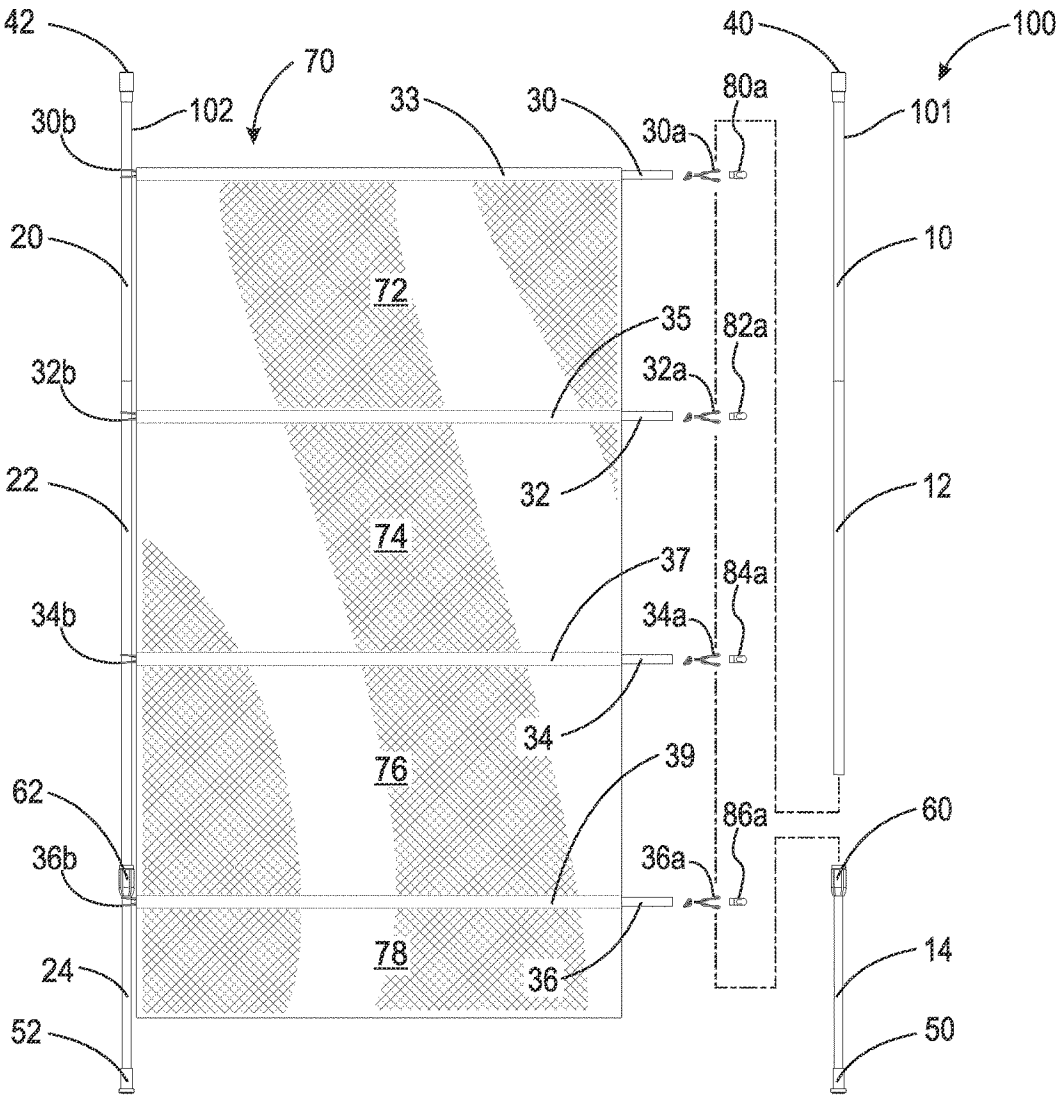
FIG. 1C is front, partial exploded view of the adjustable blind assembly.

FIG. 1C is a front, partially exploded view of adjustable blind assembly 100. This view illustrates the interaction between transverse members 30, 32, 34, and 36, sleeves 33, 35, 37, and 39, second attachment means 30*b*, 32*b*, 34*b*, and 36*b*, and telescoping tension rod 101. Transverse members 30, 32, 34, and 36 fit snuggly into sleeves 33, 35, 37, and 39, respectively. As explained supra, from a front view sleeve 33 is visible at the top of adjustable blind 70, but sleeves 35, 37, and 39 cannot be seen aside from the stitching/seams that create the sleeves. When fully assembled, first attachment means 30*a*, 32*a*, 34*a*, and 36*a* will be partially inserted into an end of its respective transverse member 30, 32, 34, and 36, threaded through endcaps 80*a*-86*a* and will be removably secured to telescoping tension rod 101. (Shown in FIGS. 6A and 6B).

Figure 2:
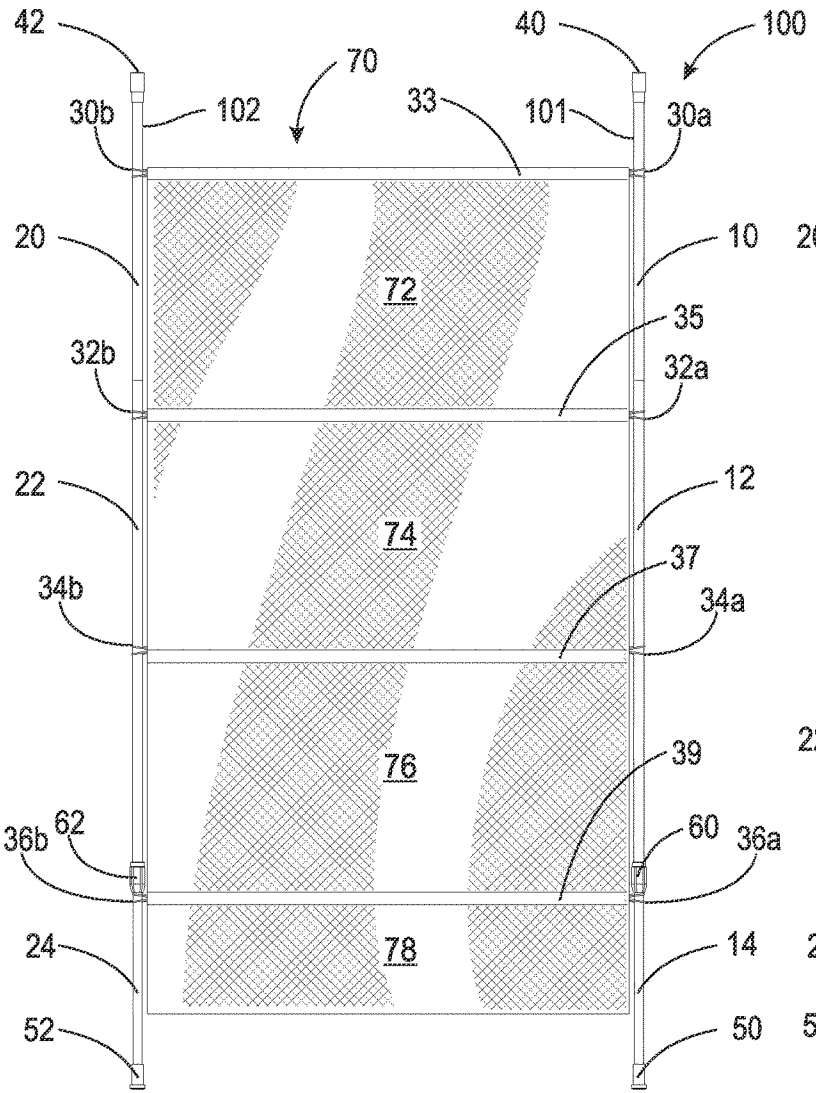
FIG. 2 is a front view of the adjustable blind assembly.

FIG. 2 is a front view of adjustable blind assembly 100. Again, in this front view, sleeve 33 is visible at the top of blind 70, meanwhile only the seams/stitching that create sleeves 35, 37, and 39 are visible transversely across blind 70. The seams, and ultimately sleeves 35, 37, and 39, divide blind 70 into four sections 72, 74, 76, and 78. Top section 72 is located between sleeves 33 and 35, top middle section 74 is located between sleeves 35 and 37, bottom middle section 76 is located between sleeves 37 and 39, and bottom section 78 is located below sleeve 39.

Figure 3:
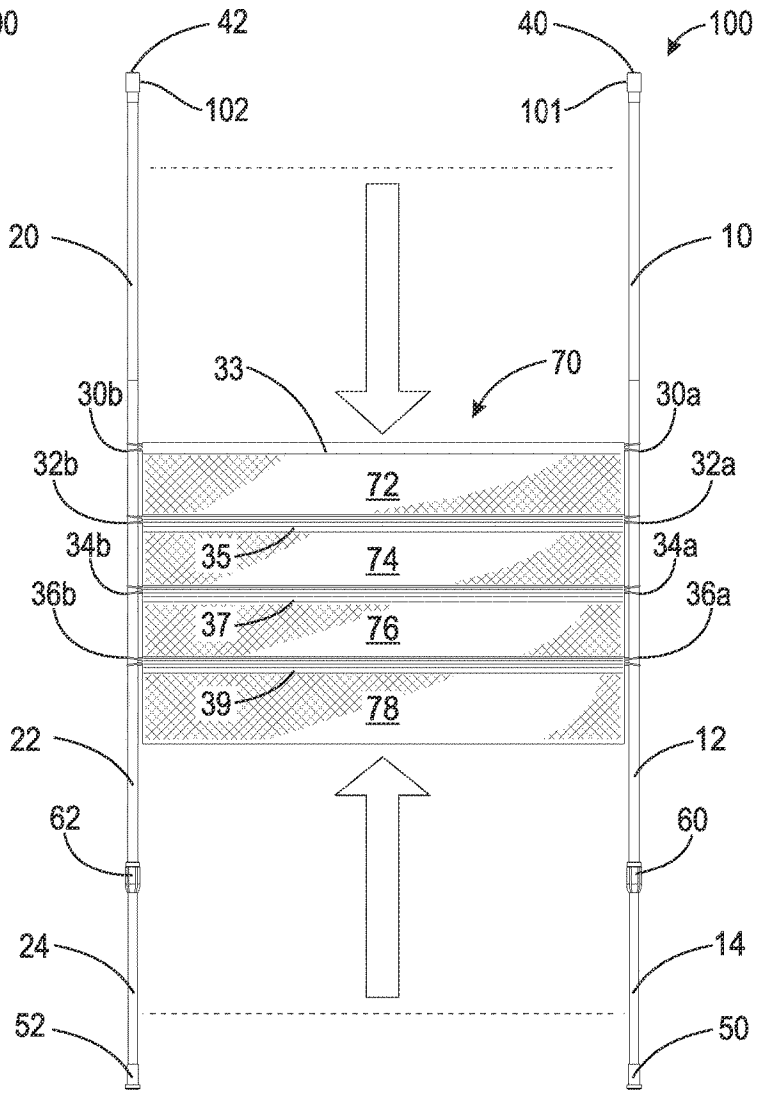
FIG. 3 is a front view of the adjustable blind assembly after adjustment of the adjustable blind.

FIG. 3 is a front view of adjustable blind assembly 100 after adjustment of the adjustable blind 70. Attachment means 30*a*-36*a* and 30*b*-36*b* may be adjusted along the length of telescoping tension rods 101 and 102, respectively. The adjustment of attachment means 30*a* and 30*b*, and necessarily sleeve 33 and transverse member 30, adjusts the top of adjustable blind 70 and top of top section 72. The adjustment of attachment means 32*a* and 32*b*, and necessarily sleeve 35 and transverse member 32, adjusts the bottom of top section 72 and top of top middle section 74. The adjustment of attachment means 34*a* and 34*b*, and necessarily sleeve 37 and transverse member 34, adjusts the bottom of top middle section 74 and top of bottom middle section 76. The adjustment of attachment means 36*a* and 36*b*, and necessarily sleeve 39 and transverse member 36, adjusts the bottom of bottom middle section 74 and top of bottom section 78. The adjustments cause adjustable blind 70 to cover a smaller space. This can be helpful if some light or visibility is wanted but not full light or visibility. For example, as the sun moves across the sky and/or gets lower, direct sunlight can be more of a nuisance. The adjustments can be used to block the direct light/rays while still allowing some natural light to illuminate a space. Notably, the excess material from blind 70 is pushed to the rear and is not visible from a front view.

Figure 4:
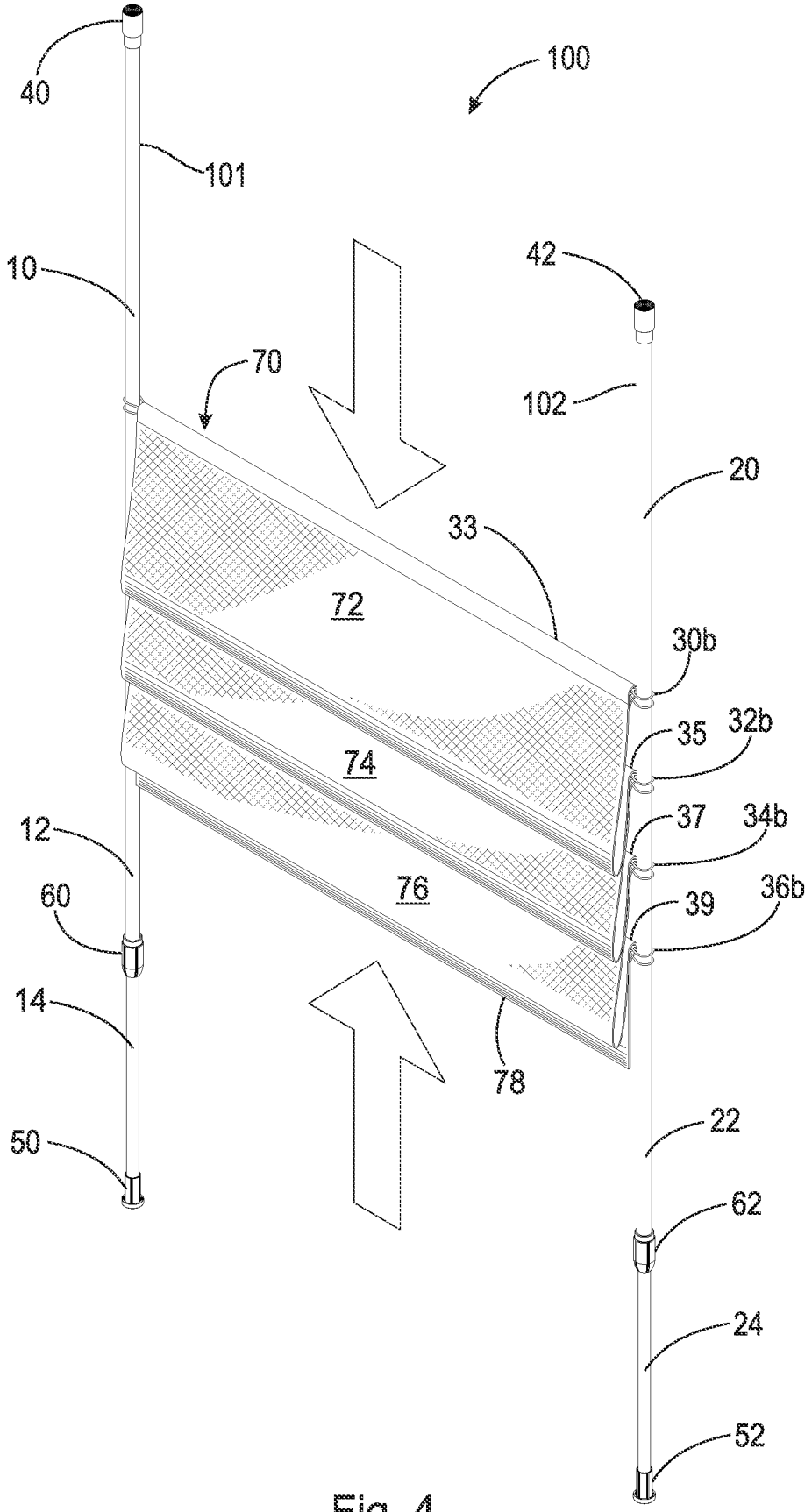
FIG. 4 is a rear perspective view of the adjustable blind assembly after adjustment of the adjustable blind.

FIG. 4 is a rear perspective view of adjustable blind assembly 100 after adjustment of the adjustable blind 70 as shown in FIG. 3. Notably, the excess material of blind 70 is visible from the rear. A portion of top section 72 is positioned behind sleeve 35 and top middle section 74. A portion of top middle section 74 is positioned behind sleeve 37 and bottom middle section 76. A portion of bottom middle section 76 is positioned behind sleeve 39 and bottom section 78. In this view you can see sleeve 33 and one end of sleeves 35, 37, and 39 and how they wrap around transverse members 30, 32, 34, and 36 and attachment means 30*b*, 32*b*, 34*b*, and 36*b*, respectively. Attachment means 30*b*, 32*b*, 34*b*, and 36*b* connect transverse members 30, 32, 34, and 36 to telescoping tension rod 102 (Shown in FIGS. 6A and 6B). Likewise, attachment means 30*a*, 32*a*, 34*a*, and 36*a* connect transverse members 30, 32, 34, and 36, respectively, to telescoping tension rod 101 (Shown in FIGS. 6A and 6B).

Figures 5A, 5B, 5C, 5D:
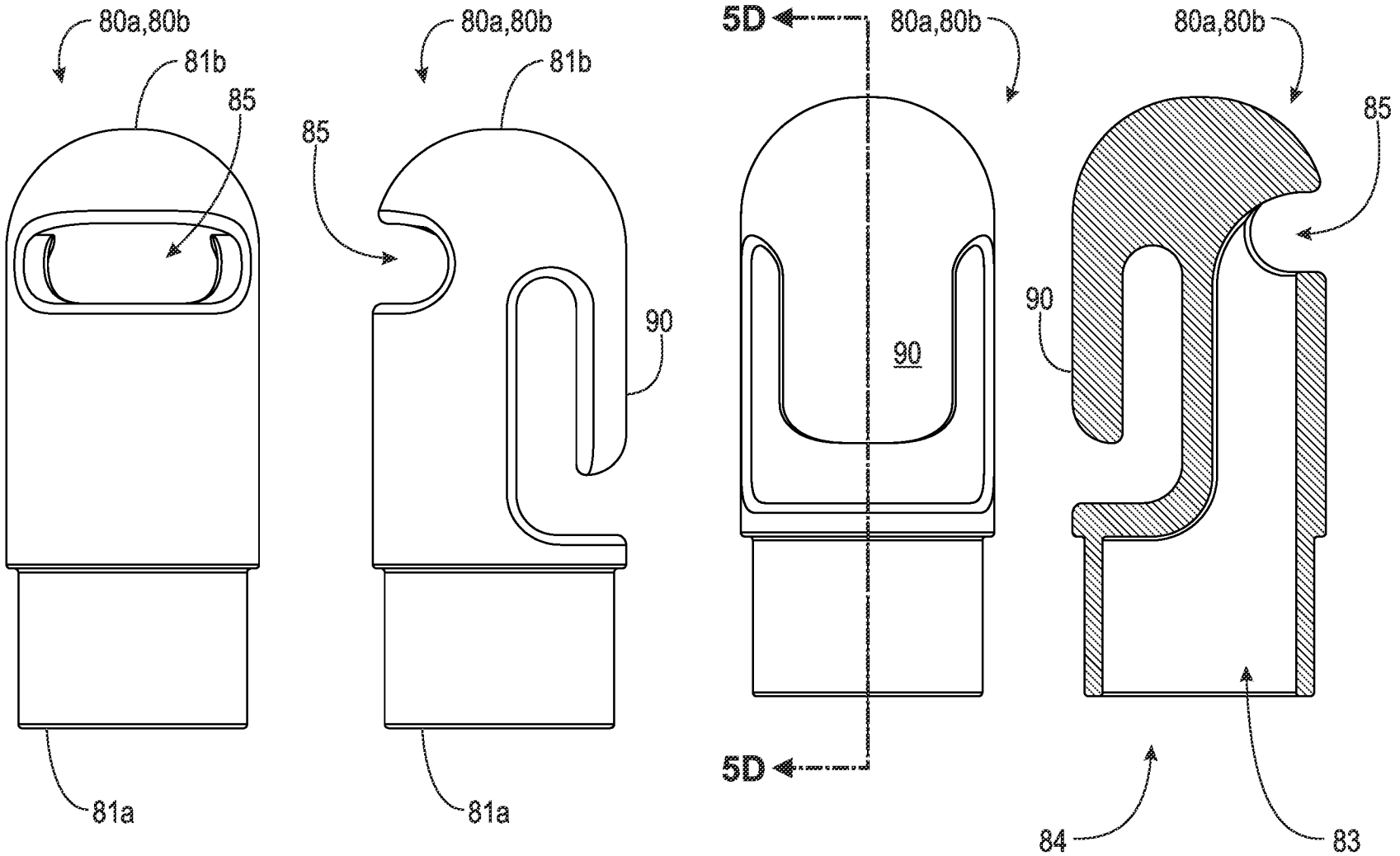
FIG. 5A is a front view of an endcap of the assembly.
FIG. 5B is a right side view of the endcap shown in FIG. 5A.
FIG. 5C is a rear view of the endcap shown in FIGS. 5A and 5B.
FIG. 5D is a cross sectional view of the endcap shown in FIGS. 5A-5C taken generally along line 5D of FIG. 5C.

FIG. 5A is a front view of endcaps 80*a* and 80*b* of adjustable blind assembly 100. Endcaps 80*a* and 80*b* comprise mating end 81*a*, external end 81*b*, internal cavity 83 (shown in FIG. 5D), opening of mating end 84 (shown in FIG. 5D), opening of external end 85, and hook 90 (shown in FIGS. 5B-5D). Endcaps 80*a* and 80*b* facilitate the connection of transverse member 30 to attachment means 30*a* and 30*b*, respectively (shown more clearly in FIGS. 6A and 6B). Notably, mating end 81*a* has a slightly smaller circumference than the remainder of endcaps 80*a* and 80*b*. This will allow mating end 81*a* to insert into an end of transverse member 30 which has a circumference substantially similar to the remainder of endcaps 80*a* and 80*b*.

FIG. 5B is a right-side view of endcaps 80*a* and 80*b* shown in FIG. 5A. This view shows how hook 90 is arranged opposite opening of external end 85.

FIG. 5C is a rear view of endcaps 80*a* and 80*b* shown in FIGS. 5A and 5B. This view shows the structure of hook 90 more closely.

FIG. 5D is a cross sectional view of endcaps 80*a* and 80*b* shown in FIGS. 5A-5C taken generally along line 5D of FIG. 5C. This view shows the internal cavity 83 extending from opening of mating end 84 to opening of external end 85. This will allow attachment means 30*a* and/or 30*b* to enter through the opening of mating end 84, through internal cavity 83 and exit the opening of external end 85 (shown more clearly in FIGS. 6A and 6B).

Figure 6A:
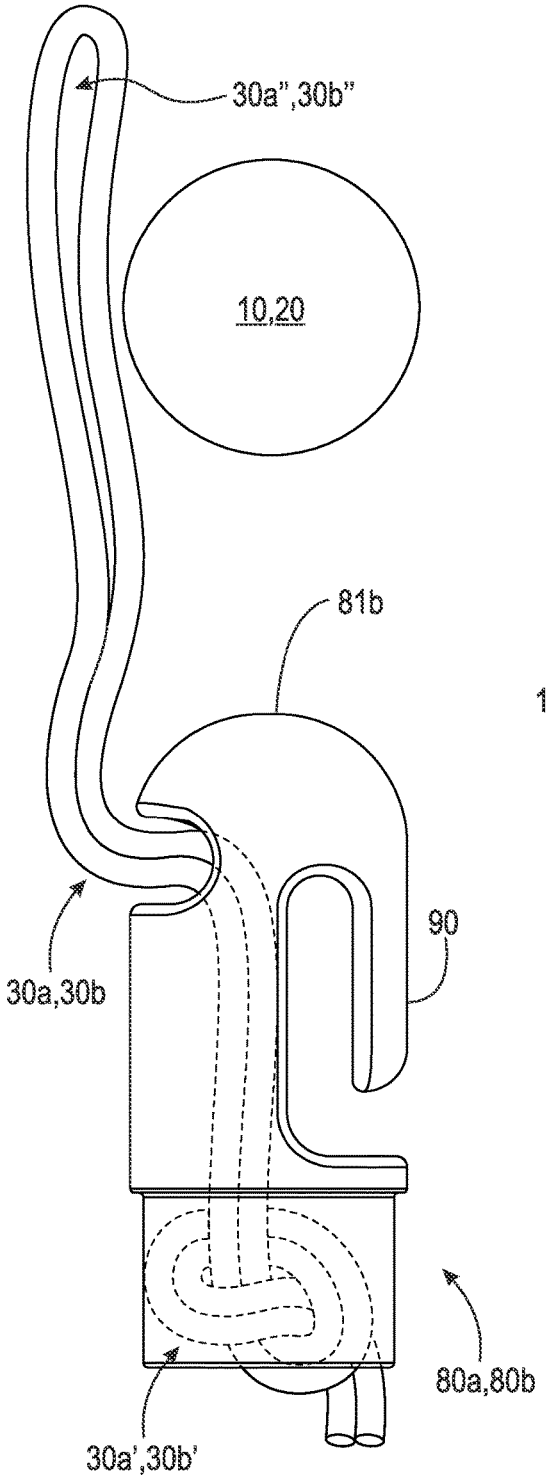
FIG. 6A is a top view of the endcap shown in FIGS. 5A-5D as it would be appear partially assembled to the adjustable blind assembly; and, FIG. 6B is a top view of the endcap shown in FIGS. 5A-6A as it would be appear fully assembled to the adjustable blind assembly.

FIG. 6A is a top view of the endcaps 80*a* and 80*b* shown in FIGS. 5A-5D as partially assembled to adjustable blind assembly 100. The dashed lines in FIG. 6A show that which would not be visible in this view and are only shown to more clearly illustrate the relationship of certain elements of the invention. In a preferred embodiment, attachment means 30*a*-36*a* and 30*b*-36*b* are an elastic material such as a bungee cord. Attachment means 30*a*, 30*b* is inserted into opening of mating end 84, pushed through cavity 83, and pulled out through opening of external end 85. Knot 30*a*', 30*b*' is tied large enough so that it cannot fit through cavity 83. Loop 30*a*", 30*b*" is pulled out through opening of external end 85 such that it can be pulled further around top members 10, 20 of telescoping tension rods 101, 102.

Figure 6B:
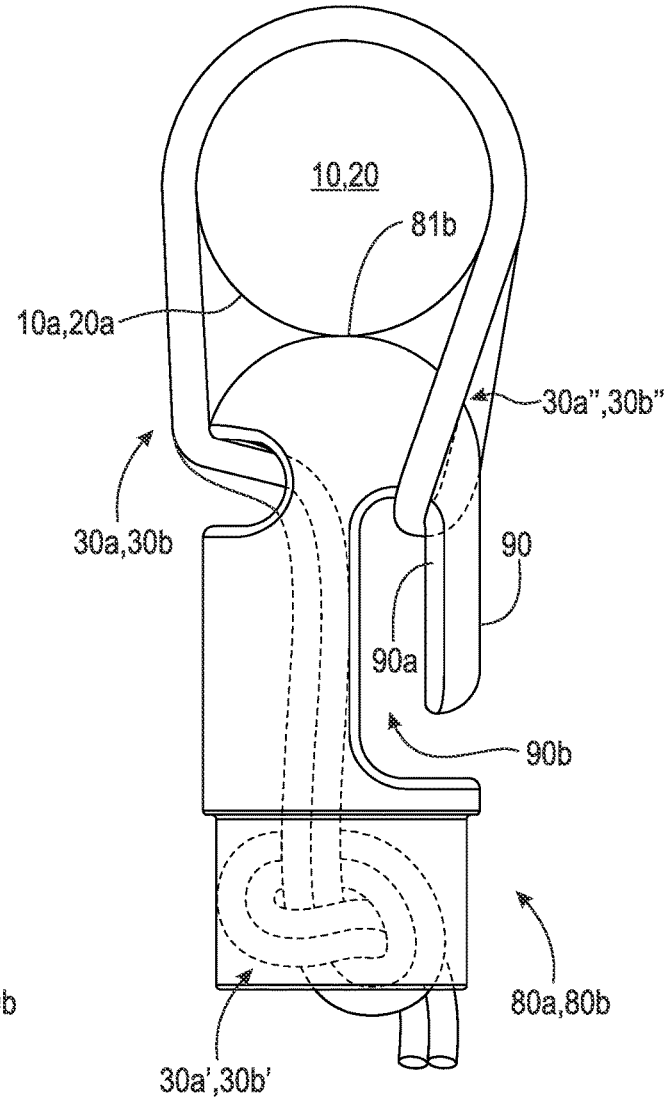

FIG. 6B is a top view of endcaps 80*a* and 80*b* shown in FIGS. 5A-6A fully assembled to attachment means 30*a*, 30*b* of adjustable blind assembly 100. The dashed lines in FIG. 6B show that which would not be visible in this view and are only shown to more clearly illustrate the relationship of certain elements of the invention. As loop 30*a*", 30*b*" is pulled tightly around top members 10, 20 external end 81*b* comes into contact with top members 10, 20. Loop 30*a*", 30*b*" is then secured around hook 90 as knot 30*a*', 30*b*' prevents attachment means 30*a*, 30*b* from pulling through cavity 83. As shown in FIG. 6B, loop 30*a*", 30*b*" is secured around hook 90 such that it rests on surface 90*a* within space or void 90*b*. When fully assembled, mating end 81*a* will be inserted into an end of transverse member 30 and an identical endcap 80*a* or 80*b* and attachment means 30*a* or 30*b* will be used to secure the other end of transverse member 30 to the opposite top member 10 or 20 of telescoping tension rod 101 or 102.

It should be appreciated that the embodiment as shown is only one of a variety of possible embodiments of the claimed invention. For example, another embodiment could have more than four (4) blind sections, or less than four (4) blind sections, the telescoping tension rods could have more than a three (3) members, or less than three (3) members. The attachment means could be any material similar to a bungee. The transverse members may be telescoping.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

REFERENCE NUMERALS

10 Top member of first telescoping tension rod
12 Middle member of first telescoping tension rod
14 Bottom member of first telescoping tension rod
20 Top member of second telescoping tension rod
22 Middle member of second telescoping tension rod
24 Bottom member of second telescoping tension rod
30, 32, 34, 36 Transverse members
30*a*, 32*a*, 34*a*, 36*a* First attachment means of Transverse members 30, 32, 34, 36
30*b*, 32*b*, 34*b*, 36*b* Second attachment means of Transverse members 30, 32, 34, 36
30*a*'-36*a*' Knot of attachment means
30*a*"-36*a*" Loop of attachment means
33, 35, 37, 39 Sleeves for Transverse members 30, 32, 34, 36
40 Spring-loaded top endcap of first telescoping tension rod
42 Spring-loaded top endcap of second telescoping tension rod
50 Non-spring-loaded foot endcap of first telescoping tension rod
52 Non-spring-loaded foot endcap of second telescoping tension rod
60 Height adjustor of first telescoping tension rod
62 Height adjustor of second telescoping tension rod
70 Adjustable blind
72 Top section of Adjustable blind 70
74 Top middle section of Adjustable blind 70
76 Lower middle section of Adjustable blind 70
78 Lower section of Adjustable blind 70
80*a*-86*a*, 80*b*-86*b* Endcaps
81*a* Mating end of Endcaps 80*a* and/or 80*b*
81*b* External end of Endcaps 80*a* and/or 80*b*
83 Internal cavity of Endcaps 80*a* and/or 80*b*
84 Opening of Mating end 81*a*
85 Opening of External end 81*b*
90 Hook of Endcaps 80*a* and/or 80*b*
90*a* Surface
90*b* Space or void
100 Adjustable blind assembly
101 First telescoping tension rod
102 Second telescoping tension rod

What is claimed is:

1. An adjustable blind assembly, comprising:

a vertical first telescoping tension rod;

a second telescoping tension rod, said second telescoping tension rod arranged parallel to said first telescoping rod;

a plurality of transverse members, each transverse member of said plurality of transverse members having a first and a second endcap arranged on opposite ends thereof, each of said endcaps arranged to engage one of said telescoping tension rods via a bungee cord, each of said endcaps comprising:

a first end and a second end;

an internal cavity, said internal cavity having a first opening at said first end and a second opening arranged proximate to said second end; and, a hook arranged on an external surface of each said endcap and arranged opposite said second opening, said hook forming a void opposite of said second opening, wherein said first end accepts and secures a first end and a second end of said bungee cord within said internal cavity, said bungee cord passing through said second opening and looping around one of said telescoping tension rods, said bungee cord engaging said hook of said endcap at a middle portion of said bungee cord and rest within said void, thereby securing by way of a lateral force said endcap to one of said telescoping tension rods such that said second end of said endcap abuts one of said telescoping tension rods;

an adjustable blind, said blind having a plurality of sleeves therein, each of said sleeves arranged to accept one of said plurality of transverse members therein; and, a height adjuster fixedly secured to each of said telescoping tension rods.

2. The adjustable blind assembly recited in claim 1, wherein said first and said second telescoping tension rods each have a top end and a bottom end, said top end of each of said telescoping tension rods having a spring-loaded endcap, said bottom end of each of said telescoping tension rods having a non-spring-loaded endcap.

3. The adjustable blind assembly recited in claim 1, wherein said first and said second telescoping tension rod are arranged to be spaced apart from one another and longitudinally parallel to each other.

4. The adjustable blind assembly recited in claim 1, wherein said plurality of sleeves comprises two sleeves.

5. The adjustable blind assembly recited in claim 1, wherein said plurality of sleeves comprises three sleeves.

6. The adjustable blind assembly recited in claim 1, wherein said plurality of sleeves comprises four sleeves.

7. The adjustable blind assembly recited in claim 1, wherein said plurality of sleeves comprises five sleeves.

8. The adjustable blind assembly recited in claim 1, wherein said first and said second telescoping tension rods are substantially vertical.

9. The adjustable blind assembly recited in claim 1, wherein said transverse members are substantially horizontal.

10. The adjustable blind assembly recited in claim 1, wherein said transverse members are arranged to be substantially perpendicular and between said first and said second telescoping tension rods.

11. An adjustable blind assembly, comprising:

a vertical first telescoping tension rod;

a second telescoping tension rod, said second telescoping tension rod arranged parallel to said first telescoping rod;

a plurality of transverse members, each transverse member of said plurality of transverse members having a first and a second endcap arranged on opposite ends thereof, each of said endcaps arranged to engage one of said telescoping tension rods via a bungee cord, each of said endcaps comprising:

a first end and a second end;

an internal cavity, said internal cavity having a first opening at said first end and a second opening arranged proximate to said second end; and, a hook arranged on an external surface of each said endcap and arranged opposite said second opening, said hook forming a void opposite of said second opening, wherein said first end accepts and secures a first end and a second end of said bungee cord within said internal cavity, said bungee cord passing through said second opening and looping around one of said telescoping tension rods, said bungee cord engaging said hook of said endcap at a middle portion of said bungee cord and rest within said void, thereby securing by way of a lateral force said endcap to one of said telescoping tension rods such that said second end of said endcap abuts one of said telescoping tension rods; and, an adjustable blind, said blind having a plurality of sleeves therein, each of said sleeves arranged to accept one of said plurality of transverse members therein.

12. The adjustable blind assembly recited in claim 11, wherein said first and said second telescoping tension rods each have a top end and a bottom end, said top end of each of said telescoping tension rods having a spring-loaded endcap, said bottom end of each of said telescoping tension rods having a non-spring-loaded endcap.

13. The adjustable blind assembly recited in claim 11, wherein said first and said second telescoping tension rod are arranged to be spaced apart from one another and longitudinally parallel to each other.

14. The adjustable blind assembly recited in claim 11, wherein each of said telescoping tension rods comprise at least a first member and a second member, said second member arranged to be inserted within said first member and translate therein.

15. The adjustable blind assembly recited in claim 14, where said height adjuster is arranged to substantially prevent translation of said second member within said first member when rotated in a first direction and allows translation of said second member within said first member when rotated in a second direction.

* * * * *